US007155755B2

(12) United States Patent
Olivier

(10) Patent No.: US 7,155,755 B2
(45) **Date of Patent: *Jan. 2, 2007**

(54) TOILET SEAT HAVING A CLEANSING FACILITY

(75) Inventor: Gerard Joseph Cecil Olivier, North Fremantle (AU)

(73) Assignee: Colivier Pty Ltd., North Fremantle (AU)

( * ) Notice: Subject to any disclaimer, the term of this patent is extended or adjusted under 35 U.S.C. 154(b) by 5 days.

This patent is subject to a terminal disclaimer.

(21) Appl. No.: 10/896,446

(22) Filed: Jul. 13, 2004

(65) Prior Publication Data

US 2005/0010997 A1 Jan. 20, 2005

Related U.S. Application Data

(63) Continuation of application No. 10/130,313, filed as application No. PCT/AU02/01407 on Nov. 17, 2000, now Pat. No. 6,769,140.

(30) Foreign Application Priority Data

Nov. 17, 1999 (AU) ..... PQ4105

(51) Int. Cl.
*A61H 35/00* (2006.01)

(52) U.S. Cl. ..... 4/447; 4/420.4

(58) Field of Classification Search ..... 4/420.1–420.5, 4/443–448

See application file for complete search history.

(56) References Cited

U.S. PATENT DOCUMENTS 4,028,745 A 6/1977 Caniglia
4,197,594 A 4/1980 Butterfield
4,237,560 A 12/1980 Riegelman et al.
4,327,451 A 5/1982 Baus
4,411,030 A 10/1983 Kawai et al.
4,653,126 A * 3/1987 Morandi et al. ..... 4/420.2
5,319,811 A 6/1994 Hauri
5,359,736 A 11/1994 Olivier
5,706,525 A 1/1998 Olivier

FOREIGN PATENT DOCUMENTS

WO WO 95/08030 3/1995

* cited by examiner

*Primary Examiner*—Huyen Le
(74) *Attorney, Agent, or Firm*—Merchant & Gould P.C.

(57) ABSTRACT

A toilet seat (10) having a cleansing facility with an pivotable arm (18) supplied with warm water for cleaning and warm air for drying the anal and genital areas of a user. The arm (18) being automatically controlled to operate along a path substantially parallel with the central fore and aft axis of the toilet seat (10) between a stored position and an active position. The water is supplied though a duct (36) which has a relatively small cross-sectional area and the air is supplied through a duct (44) having a relatively large cross-sectional area so as to provide respectively differing volumes of fluid to the user. The water duct (36) and air duct (44) are substantially parallel and both terminate in upward disposition to direct the water and air upwardly onto the user at a close range for efficient cleaning and drying, respectively. The toilet seat (10) has a bi-directional fan (50) that rotates clockwise for delivering air to the anal area of the user and anti-clockwise for delivering air to the genital area of the user. A heater coil (49) is provided in the air duct (44) and optionally upstream of the fan (50). A second water outlet (60) is provided for cleaning male genitals and can be manipulated to adjust its orientation.

18 Claims, 8 Drawing Sheets

TOILET SEAT HAVING A CLEANSING FACILITY

This application is a continuation of application Ser. No. 10/130,313, filed 2 Aug. 2002 now U.S. Pat. No. 6,769,140, which is a 371 of PCT/AU02/01407, filed 17 Nov. 2000, which claims priority to Australian Application No. PQ 4105, filed 17 Nov. 1999, which application(s) are incorporated herein by reference.

FIELD OF THE INVENTION

This invention relates to a toilet seat having a cleansing facility.

BACKGROUND

The feature of the present invention comprises a development of two earlier inventions which were disclosed in International patent application PCT/AU91/00523 and PCT/AU94/00537

Throughout the specification the term pedestal should be taken to include toilet pedestals of a substantially conventional form which defines a pan and which is capable of receiving a toilet seat. In addition, the toilet seat should be taken to include a toilet seat which is adapted to be mounted to a pedestal to overlie the rim of the pedestal to provide support for an occupant, said toilet seat having an opening which overlies the pan of the pedestal.

DISCLOSURE OF THE INVENTION

Accordingly, the invention resides in a toilet seat having a cleansing facility, said toilet seat supporting one end of an arm at one side of the periphery of the opening, said one end being supported from the toilet seat by a mounting which enables the arm to be moveable along a longitudinal path which is substantially parallel with the central fore and aft axis of the toilet seat, said mounting also enabling pivotal movement of the arm when the arm is at a position on the path between a stored position at which the arm lies within or closely adjacent inner periphery of the toilet seat and an active position at which the arm extends laterally from the inner periphery of the toilet seat across the opening such that its other end lies generally in the region of the central fore and aft axis of the toilet seat, said arm having a water supply duct adapted to receive water from a water delivery means, the water duct terminating at the other end of the arm as a water outlet, the water outlet being directed upwardly when the arm is in its active position, a control means operatively associated with the drive means and the water delivery means, said control means being adapted to cause activation of the drive means to cause the arm to move from its stored position to its active position, to move along the longitudinal path to one or more locations along the path, to cause activation of the water delivery means to enable the delivery of water from the water outlet when at the one or more locations.

According to a further preferred feature of the invention the pivotal movement of the arm is about a substantially upright axis.

According to a further preferred feature of the invention, the mounting comprises a longitudinal track provided in the toilet seat and the one end of the arm is slidably supported from the track. According to a further preferred feature, the mounting further comprises a slider, slidably supported on the track, said arm being pivotally supported from the slider to be movable between the stored and active position when at the said position. According to a further preferred feature of the invention, said position is located at one end of the path whereby the arm is in its stored position when the slider is at the one end of the path and the arm is moved from the stored position to the active position as the slider moves from the one end of the path and the arm moves from the active position to the stored position as the slider moves approaches the one end of the path. According to one particular embodiment, the movement of the arm between the stored and active position is effected by a bearing member provided on the arm slidably engaged with a formation on the toilet seat.

According to a further preferred feature of the invention, the water supply duct is connected at the one end of the arm to a delivery conduit provided in the toilet seat which is connected to source of water said delivery conduit comprising the water delivery means. According to one embodiment, the source of water comprises the mains supply and the water delivery means further comprises a control valve operatively controlled from the control means and associated with the delivery conduit. According to an alternative embodiment, the source of water comprises a reservoir and the connection to the water duct is effected through a pump controlled from the control means.

According to a preferred feature of each of the embodiments, a water heater is associated with the water supply.

According to a preferred feature of the invention, a first air duct is provided in the arm, the said first air duct terminating in an air outlet at the other end of the arm which will be directed upwardly when the arm is in its active position, said first air duct being associated with at least one second air duct provided in the toilet seat and an air delivery means connected to the second air duct, said first air duct communicating with the at least one second air duct when the arm is in its active position and is at said one or more locations.

According to a further preferred feature of the invention, the slider has a passage which is connected to the first air duct when the arm is in its active position, said passage communicating with the at least one second duct when the arm is at said one or more locations. According to a further preferred feature of the invention said at least one second air duct comprises two second air ducts each having an outlet, the outlets being located in spaced positions along the track, said one or more locations comprising two locations and wherein said passage engages with one or the other outlets when it is at the respective locations.

According to a further preferred feature of the invention, each of the second air ducts are connected to a common inlet and a means is provided for directing airflow from the inlet to the outlet of which the slider is located. According to a preferred feature of the invention, the air delivery means comprises a fan.

According to a further preferred feature of the invention an air heating means is provided in association with the first and/or second air duct and which is controlled by the control means to heat air delivered from the outlet. According to one embodiment the heating means comprises a heating element located in the first duct in heat exchange relationship with the flow path through the first duct. According to another embodiment the heating means comprises a heating element provided between the fan and the inlet.

According to a further preferred feature of the invention, the toilet seat further comprises a second water outlet located at the forward inner periphery of the opening, the delivery of water to the second water outlet being controlled by the control means.

According to a further preferred feature of the invention, said second water outlet is capable of being manipulated to control the direction of the water flow.

The invention will be more fully understood in the light of the following description of several specific embodiments.

BRIEF DESCRIPTION OF THE DRAWINGS

The description is made with reference to the accompanying drawings of which.

DETAILED DESCRIPTION OF SPECIFIC EMBODIMENTS

The first and second embodiment both relate to a toilet seat that is intended for use with a toilet pedestal of substantially convention form. The toilet seat may be pivotally supported from the pedestal such that it can be raised out of engagement with the pan if desired or can be lowered to provide support for an occupant. The toilet seat according to the first and second embodiment each incorporates a washing and drying facility whereby an occupant is able to wash and dry themselves prior to departing the toilet.

The toilet seat according to the first embodiment comprises an annular rim which defines the opening of the toilet seat and which is formed as a hollow shell 10. The rim is formed in two halves comprising a lower shell 10*a* and an upper shell whereby the upper shell provides the support surface for an occupant. The upper and lower shells define between themselves a plenum which accommodates the washing and drying facility of the first embodiment. A slot (not shown) is provided in the wall of the shell, at the junction of the upper and lower portions of the shell at one side of the inner periphery of the opening 12.

Figure 2:
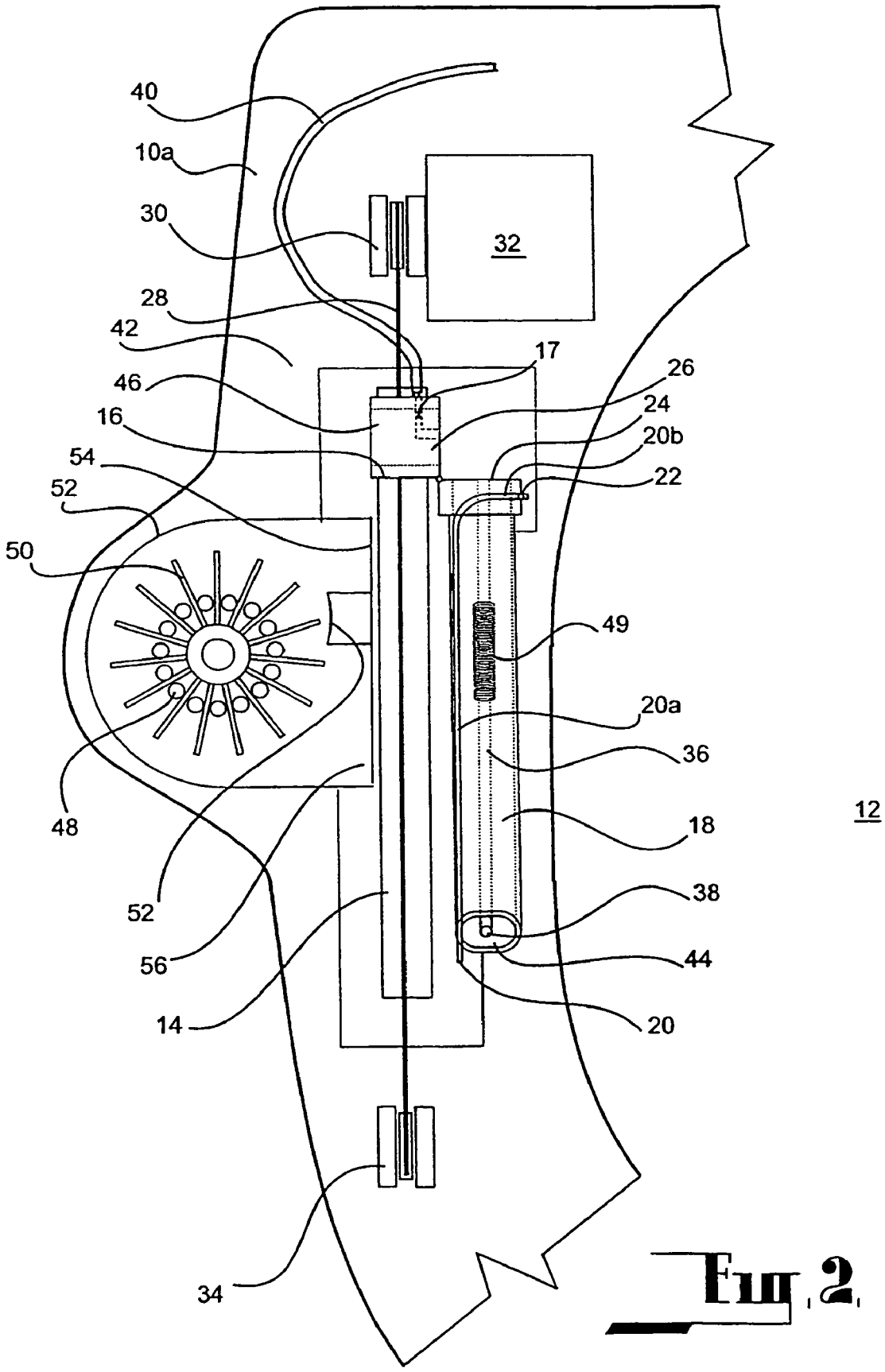
FIG. 2 is a part sectional plan view of the toilet seat according to the first embodiment illustrating the arm in the stored position.
Figure 4:
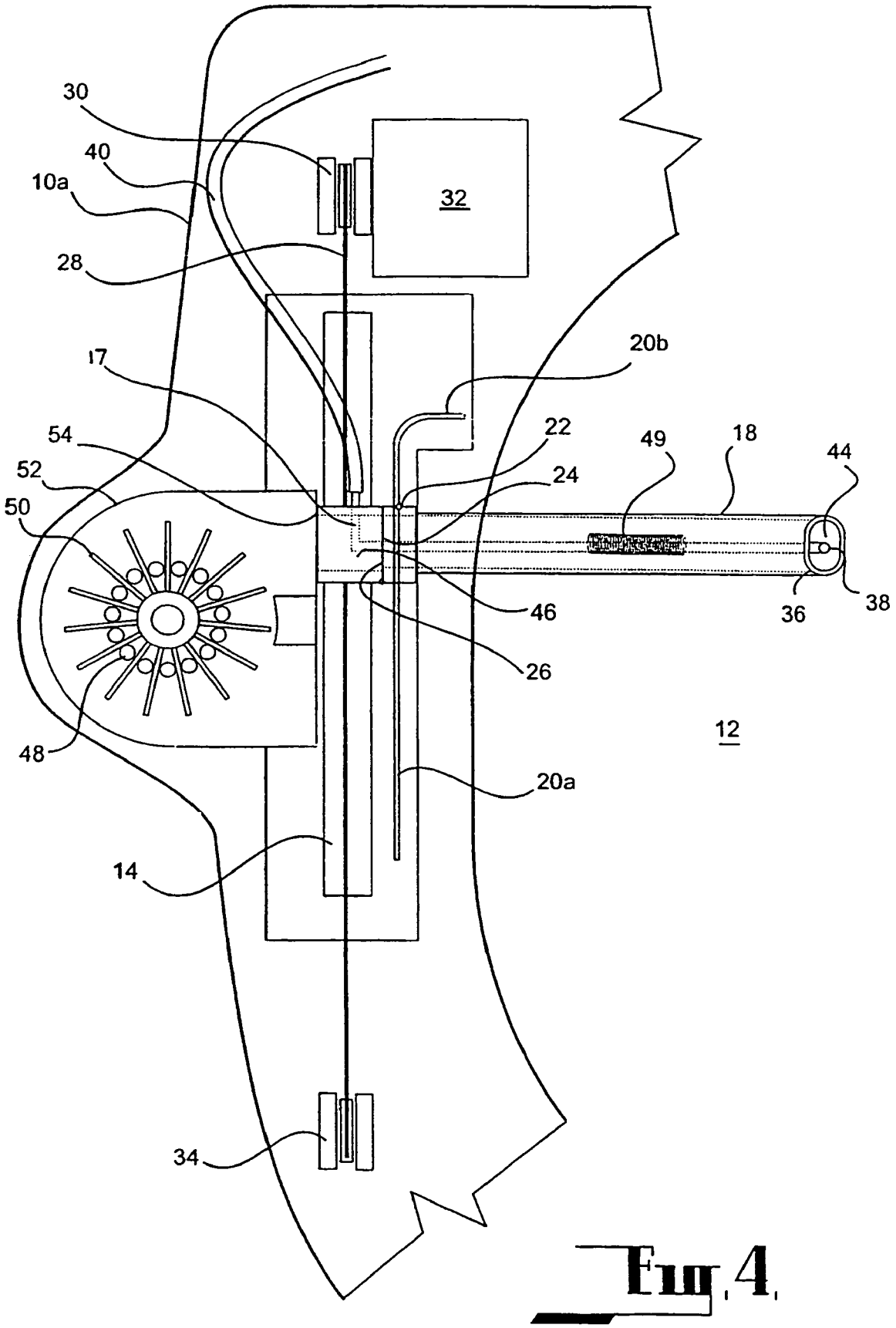
FIG. 4 is a partial sectional view of the first embodiment of the invention illustrating the arm in its active position at one location along its path.
Figure 5:
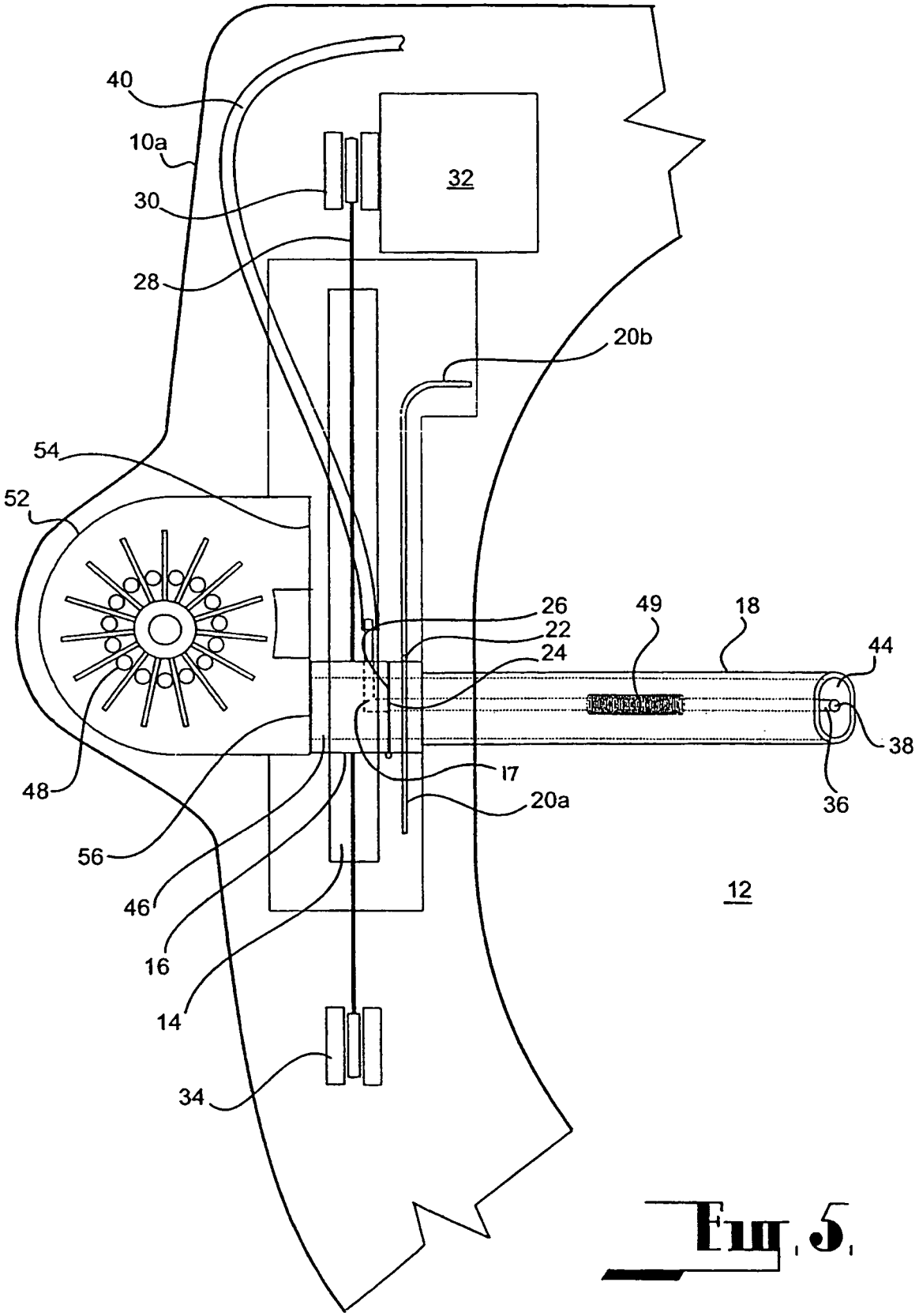
FIG. 5 is a part sectional plan view of a toilet seat according to the first embodiment illustrating the arm in its active position at another location.
Figure 6:
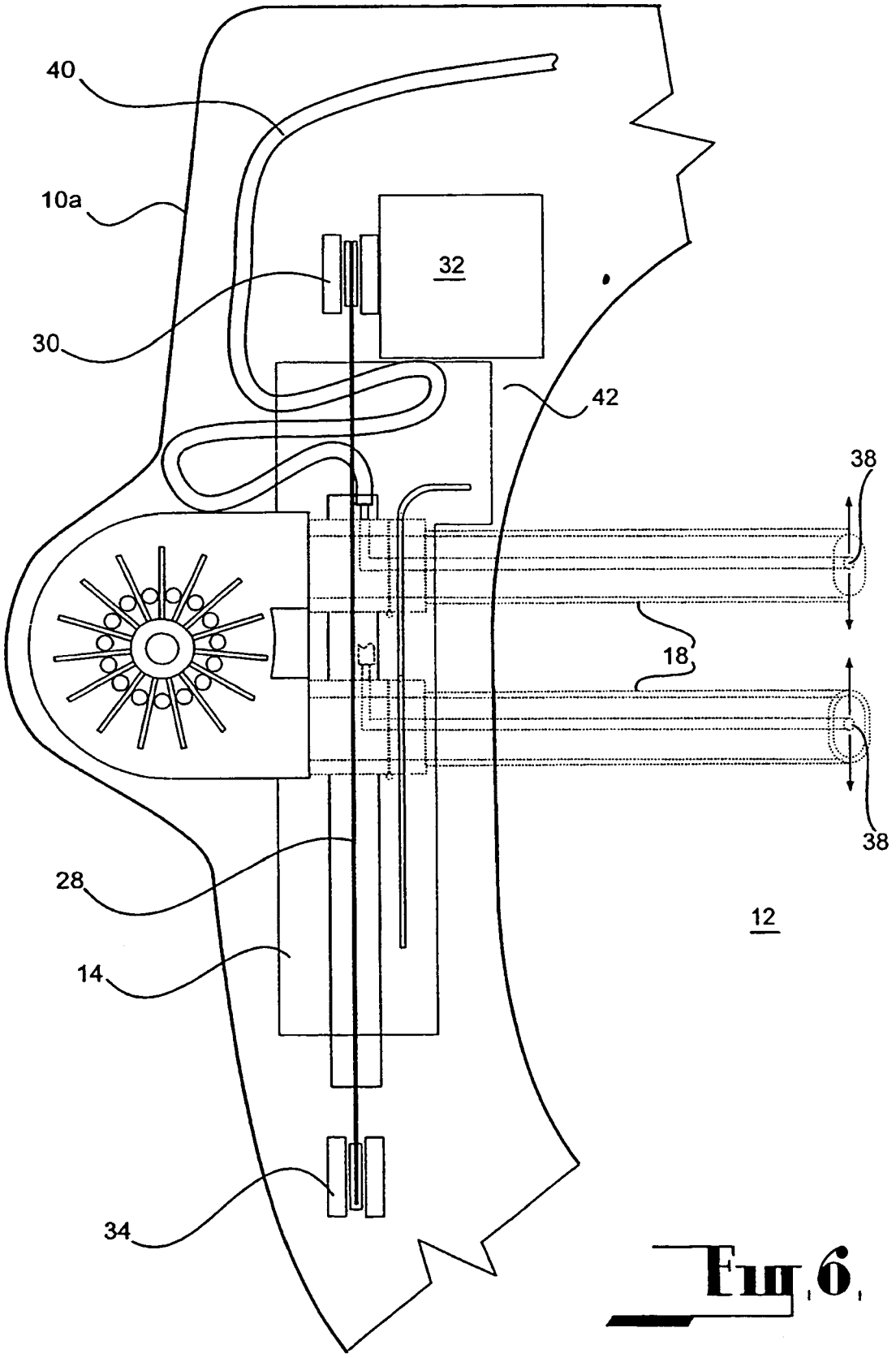
FIG. 6 is a part sectional plan view of the first embodiment illustrating the movement of the arm when its in its active position.
Figure 7:
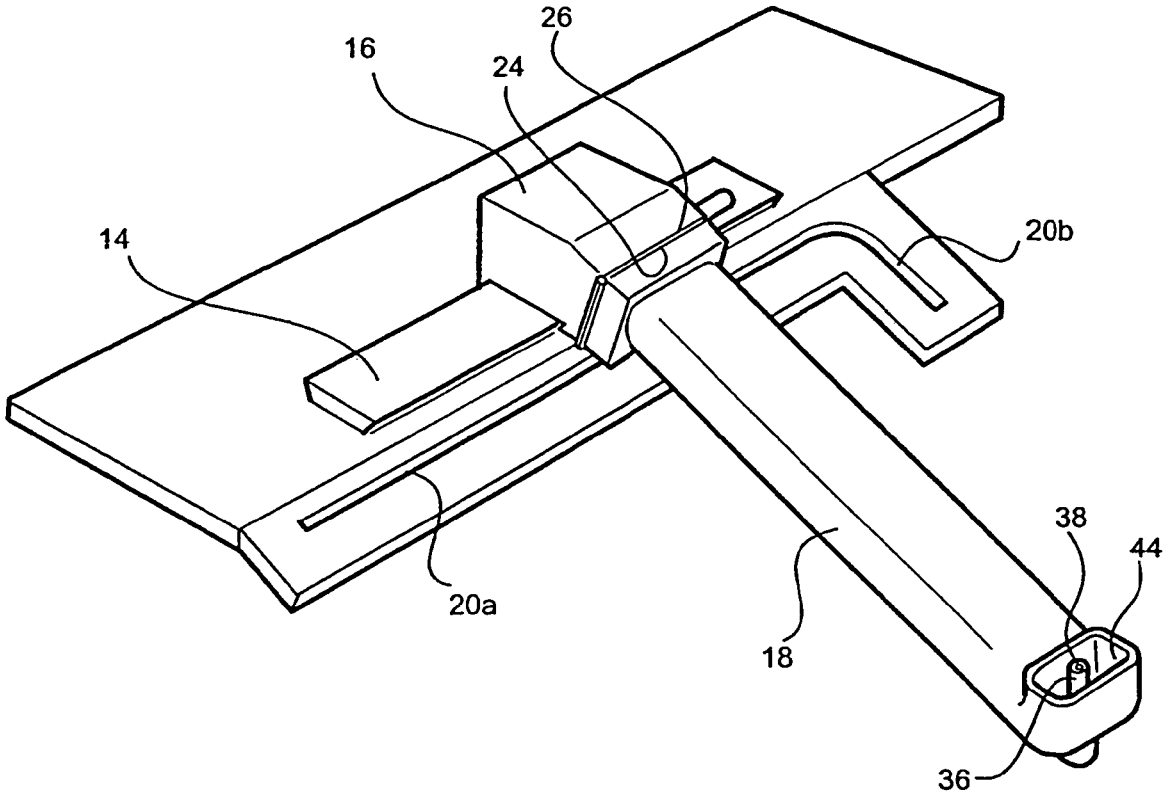
FIG. 7 is an isometric view of the arm supported on the track according to the first embodiment with the arm in its active position.

The inner surface of the lower shell is provided with a longitudinal track 14 which is located opposite the slot. As shown at FIG. 7 the track is formed as a raised rib where the sides of the rib are convergent away from the lower shell 10*a*. The track 14 slidably supports a slider 16 which is formed with a groove of complementary profile to the track to be slidable along the track 14. An arm 18 is pivotally supported from the slider 16 at one side of the slider whereby it is moveable from a stored position as shown in FIG. 2 at which it lies between the shells of the rim and is substantially parallel to the track 14 and an active position as shown at FIGS. 4, 5 and 6 at which the arm extends perpendicularly from the track 14 beyond the slot and across the opening 12 of the toilet seat such that its outer end is located substantially on the central fore and aft axis of the toilet seat.

Figure 1:
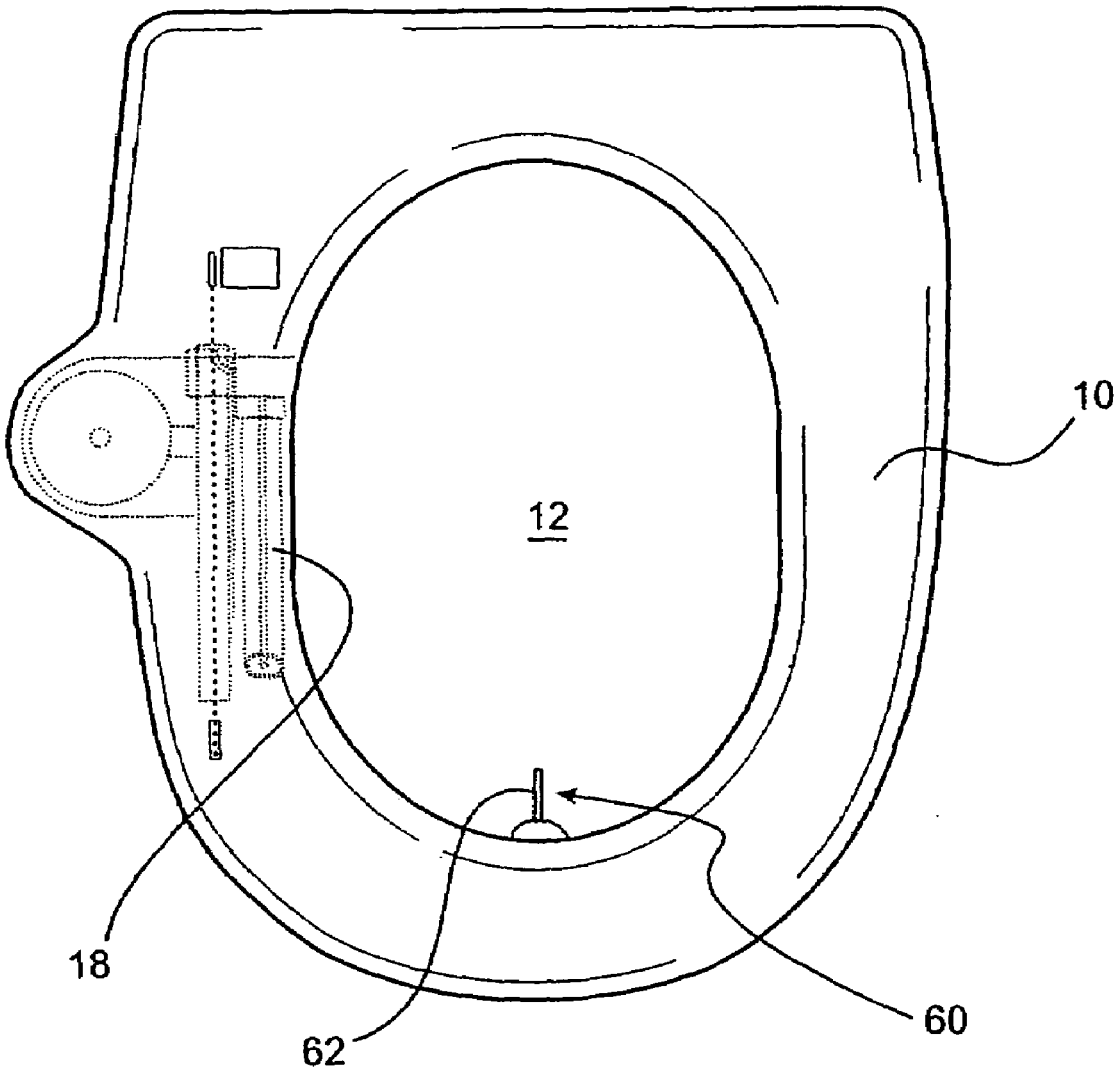
FIG. 1 is a plan view of a toilet seat according to the first embodiment with the arm in the stored position.
Figure 3:
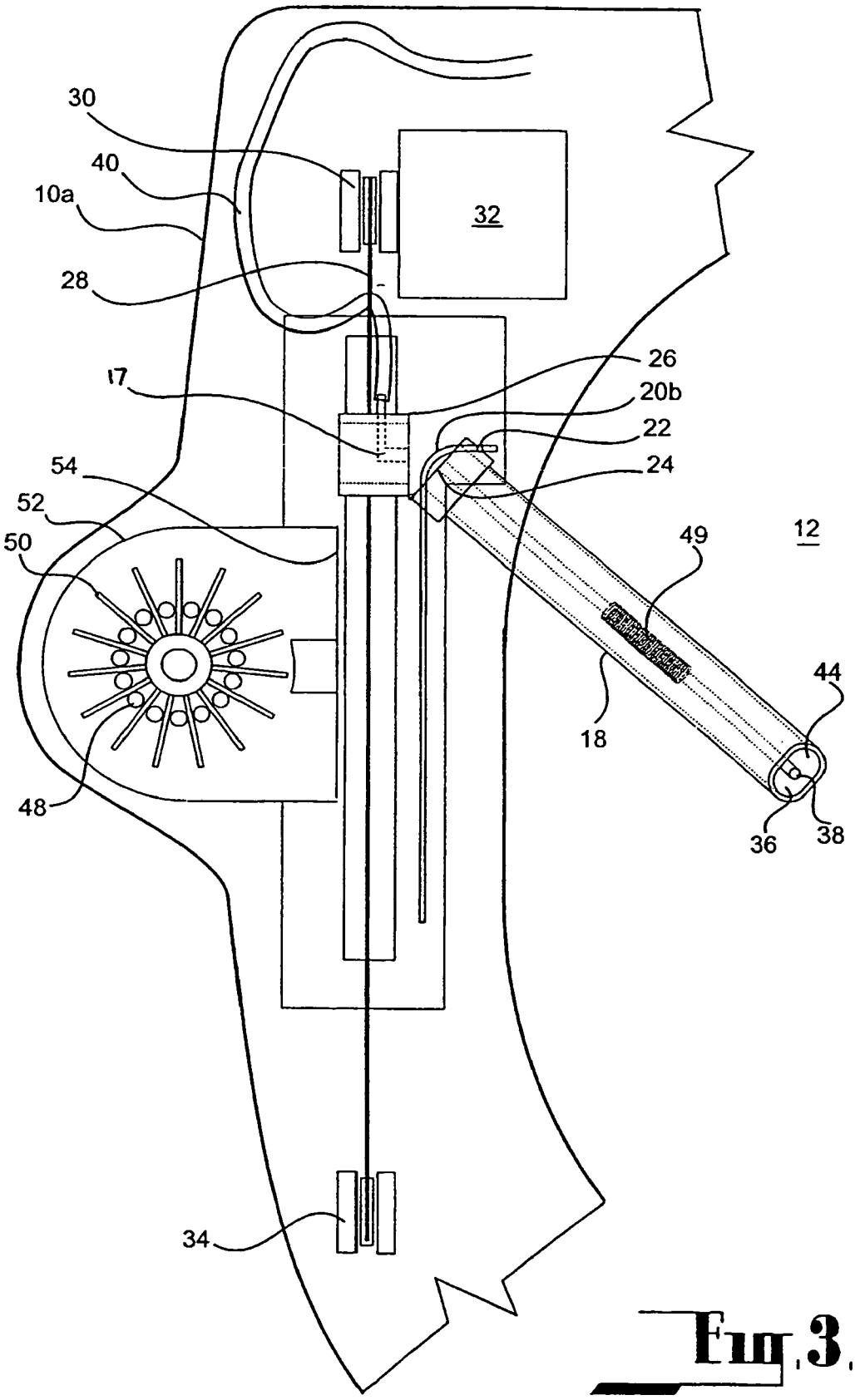
FIG. 3 is a sectional plan view of the toilet seat according to the first embodiment illustrating the arm in an intermediate position between its stored and active position.

The track 14 is associated with a groove 20 which is provided in the lower shell 10*a* of the toilet seat where the groove has a main portion 20*a* which is parallel to track 14 and extends for substantially the full length of the track 14. The groove has a second portion 20*b* at one end of the first portion 20*a* which extends perpendicular to the first portion 20*a* away from the track 14. The arm 18 is provided with a peg 22 which is slidably received within the groove 20. As a result of the movement of slider 16 on the track 14 the arm 18 is carried with the slider 16 and is caused to pivot on the slider 16 as a result of the engagement of the peg 22 in the groove 20. Such movement results in the pivotal movement of the arm between the stored position as shown at FIGS. 1 and 2 and the active position as shown at FIGS. 4, 5, 6 and 7 through an intermediate position as shown at FIG. 3. When the slider 16 is at the end of the track 14 proximate the second portion 20*b* of the groove 20 the engagement of the peg 22 in the second portion 20*b* causes the arm 18 to be located in its stored position. As the slider 16 moves from the one end of the track, the peg 22 is caused to move along the groove 20 and as a result of the configuration of the junction between the first and second portion 20*a* and 20*b* of the groove, the arm is caused to be moved from the stored position as shown at FIG. 1 and 2 through an intermediate position as shown at FIG. 3 at which the arm is oblique to the track 14 and to an active position as shown at FIGS. 4, 5 and 6 at which the arm is perpendicular to the track 14.

The movement of the slider 16 along the track 14 is effected through a cable 28 which is formed as an endless loop between a drive roller 30 supported from the drive shaft of a drive motor 32 which is located at the rearward end of the track 14 and an idler roller 34 which is located at the forward end of the track 14.

The arm 18 is provided with a first water duct 36 which extends for the length of the arm 18 and terminates at the outer end of the arm with an upwardly directed nozzle 38 provided at the outer end of the water duct. The one end of the arm 18 which is pivotally supported from the slider 16 is provided with an axial end face 24 which is intended to be bought into face to face engagement with the adjacent face 26 of the slider 16 when the arm 18 is in its active position. The slider 16 is provided with a second water duct 17 which at a first end is connected through a coupling 42 to a flexible water delivery conduit 40 which is able to accommodate the movement of the slider along track 14. The other end of the second water duct 17 in the slider 16 terminates at the adjacent face 26 and is brought into communication with the first water duct 36 in the arm 18 at the end face 24 when the arm 18 is in its active position. The second water duct 17 in the slider 16 thereby forms an extension of the first water duct 36. The water delivery conduit 40 is connected to a reservoir (not shown) through a pump (not shown) whereby when the arm 18 is in its active position and on activation of the pump, water will be delivered from the reservoir to the outlet nozzle 38. The reservoir accommodates a heater for heating the water contained therein.

In addition the arm 18 is hollow to provide an air duct which extends from the axial end face 24 at the one end of the arm to the outer end of the arm whereby the outer end of the arm is directed upwardly to provide an upwardly directed air outlet 44 which surrounds the water nozzle 38. In addition, the slider 16 is provided with a passage 46 which extends from the face 26 which is to sealingly engaged by the adjacent face 24 of the arm 18 when in the active position, to the opposite face of the slider. As a result when the arm is in its active position, the passage 46 formed within the slider 16 comprises an extension of the air duct provided in the arm 18.

The lower shell 10*a* of the toilet seat provides the forced air supply for the first embodiment. The forced air supply comprises a fan which is accommodated by the shell to provide a suitable cowl to enable the air to be delivered to the passage 46 within the slider and the duct 44 within the arm 18 when the arm is in its active position. The air delivery means comprises an inlet 48 formed in the lower face of the lower shell and which is defined by a circular array of apertures in the lower shell. The apertures are associated with a fan blade 50 rotatably supported from the lower shell to be located above the upper face of the shell. The fan blade is drivingly connected to a motor (not shown) supported from the under face of the lower shell. The fan blade 50 is associated with a cowl 52 provided on the lower shell 10*a* which is intended to span the space between the lower shell 10*a* and the upper shell to define a space which surrounds the fan blade 50. The cowl 52 is provided with a pair of outlets 54 and 56 which are located adjacent the track 14 at spaced locations along the track. The motor driving the fan blade 50 is a bi-directional motor whereby it is capable of causing rotation of the fan blade 50 in either direction. When the fan blade is cause to rotate clockwise air will be delivered from the inlet 48 to the first outlet 54 which is located proximate the rear end of the track 14 and when the fan blade 50 is caused to rotate in an anti-clockwise direction, air will be delivered from the second outlet 56 which is located intermediate of the length of the track 14. In addition a heating coil 49 is located within the air duct between the axial end face 24 of the arm and the air outlet 44 in order to heat the air being delivered into air duct from the outlets 54 and 56

The toilet seat according to the first embodiment is provided with a control means (not shown) which serves to control the action of the drive motor 32 which in turn causes the movement of the slider along the track and the consequent longitudinal and pivotal movement of the arm 18. In addition the control means controls the operation of the pump delivering water to the water conduit 40, and the motor driving the fan blade 50. The control means is associated with a switch which is capable of causing the control means to activate the drive motor, pump, fan motor and heating element.

In use, the arm when in the active position is caused to occupy two locations along the track which correspond to positions at which the slider 16 is located directly opposite the first or second outlet 54 and 56 of the air delivery means. When at each of those locations the passageway 46 through the slider 16 is in sealingly engagement with the respective outlet in order that the air delivered by the fan blade 50 is delivered to the outer end of the air duct 44 provided in the arm.

When in the inactive state, the arm 18 is located in the stored in the stored position as shown at FIGS. 1 and 2.

In the event that the occupant of the toilet requires to be washed and dried before departing the toilet seat, the control means is activated which causes activation of the drive motor 32, which in turn causes the slider 16 to be carried along the track 14 and in so doing causes the arm 18 to move from the stored position to the active position.

According to one mode of operation, on activation of the control means, the arm 18 is moved to its rearmost intermediate location along the track 14 (see FIGS. 4 and 6) at which the slider 16 is located adjacent the first outlet 54 of the air delivery means. When at that position, the outer end of the arm 18 is intended to be positioned substantially below the anus of the occupant. According to another mode of operation, on activation of the control means, the arm 18 is caused to move to its forwardmost intermediate position along the track 14 (see FIGS. 5 and 6) at which the slider 16 is engaged with the second outlet 56 at which position and the outer end of the arm is located substantially below the genitalia of the occupant. According to a further mode of operation of the device, on activation of the control means the arm is caused to move to the rear most position at which the slider 16 is located adjacent the first outlet 54 and then to the intermediate position which the slider 16 is located adjacent the second outlet 56.

On the control means causing the movement of the arm to the active position according to any one of the modes of operation referred to above on the arm moving to a location, the pump is activated to cause the delivery of water from the water outlet nozzle 38 whereby the water will be directed onto the portion of the body of the occupant above the nozzle. After a period of time, the pump is deactivated and the fan motor and heater elements are activated causing the delivery of warm air from the respective outlet 54 and 56 such that air is directed onto the portion of the body of the occupant above the air outlet. After the completion of the desired period of time for the delivery of the air, the arm will then be moved to the other location if appropriate or alternatively will be returned to the stored position.

As shown at FIG. 6 when water is being delivered from the water outlet 38, the arm may be caused to reciprocate along the fore and aft axis to either side of the location in order to wash an extended area of the occupant.

As a result of the first embodiment, a means is provided in association with the toilet seat where the anus and/or the genitalia of the occupant can be washed before occupant departs the toilet seat. In effecting the cleansing action, a flow of water is directed onto the appropriate portion of the body of the occupant and on completion of the delivery of the water, a flow of air is directed onto the body of the occupant in order to dry the occupant. The mode of operation of arm 18 can be varied depending upon the gender of the occupant and the purpose for the occupation of the occupant on the toilet seat.

In addition, the toilet seat according to the first embodiment is provided with a secondary washing means 60 which is provided at the forward inner periphery the opening 12. The secondary washing means comprises an outlet nozzle 62 which is provided at the forward inner periphery of the opening 12 and is connected to the reservoir through a second conduit (not shown) through a pump (not shown). The nozzle 62 is adapted to provide a restricted but directional flow of water and is capable of being manipulated. The purpose of the secondary washing means is to enable a male occupant to wash the end of his penis at the completion of urination before departing the toilet seat. The delivery of water from the outlet 62 is effected from a further control associated with the control means.

It is a further feature of the first embodiment that the toilet seat when in its lower position will sealingly engage with the rim of the pedestal. This is achieved by a seal in the form of an annular flexible resilient member fixed to the underneath of the seat which will engage with the rim when the toilet seat is in the lowered condition. The function of the seal is to prevent the escape of odours from the toilet bowl through the space between the seat and the rim when an occupant is present on the seat. This will then increase the likelihood of the odours being extracted from the toilet bowl on the flushing of the toilet.

Figure 8:
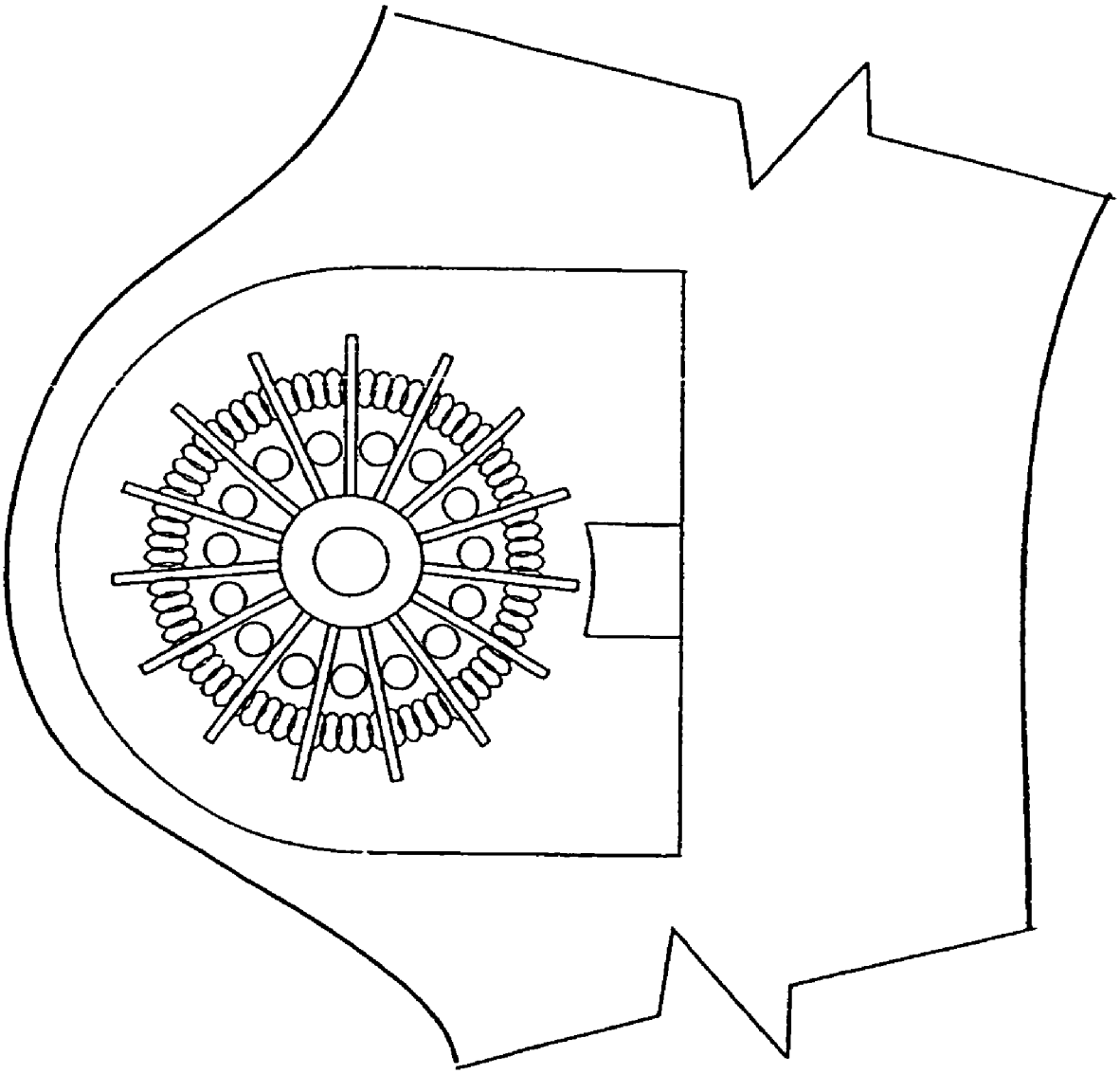
FIG. 8 is a part sectional view of a portion of the second embodiment which illustrates the air heating arrangement according to the second embodiment.

According to a second embodiment of the invention and as shown at FIG. 8 the air being delivered to the air outlet is heated by a circular heating coil 149 is located between the inlet 148 in the lower shell 110*a* and the fan blade 150 in order to heat the air being delivered to the outlets 154 and 156

According to a third alternative embodiment of the invention the arm is mounted to the toilet seat in a similar manner to that shown and described in relation to the first embodiment with the exception that the arm is in its stored position when the carrier is at its forwardmost position on the track and moves to its active position as the arm moves rearwardly on the track from the stored position. As a result when the arm has been moved to its active position it is moved to a variety of positions to achieve the same cleansing actions as in the first embodiment.

In a further alternative embodiment of the invention, the water delivery conduit 40 is connected directly to the inner end of the arm 18 by means of a flexible coupling, rather than to the slider 16, and as a result the slider 16 is not required to have the second duct 17.

Throughout the specification, unless the context requires otherwise, the word "comprise" or variations such as "comprises" or "comprising", will be understood to imply the inclusion of a stated integer or group of integers but not the exclusion of any other integer or group of integers.

It should be appreciated that the scope of the present invention need not be limited to the particular scope of the embodiments described above.

The invention claimed is:

1. A cleansing facility suited for use with a toilet seat shell, the toilet seat shell defining an opening, the cleansing facility comprising:

an arm including a water supply duct terminating at a water outlet at a first end of the arm, and an air supply duct terminating at an air outlet at the first end of the arm, the air supply duct having a cross-sectional area greater than a cross-sectional area of the water supply duct;

wherein the arm is supported at a second end thereof by the shell at one side of the periphery of the opening;

wherein the arm is configured to move longitudinally along a central axis of the seat; and wherein the arm is configured to pivot in a plane substantially parallel to a bottom of the seat.

2. The cleansing facility of claim 1, further comprising a water supply system configured to provide water to the water supply duct.

3. The cleansing facility of claim 2, further comprising a controller being adapted and configured to activate the water supply system to deliver water to the water outlet.

4. The cleansing facility of claim 1, further comprising an air delivery system configured to provide air to the air supply duct.

5. The cleansing facility of claim 4, further comprising a controller being adapted and configured to activate the air delivery system.

6. The cleansing facility of claim 1, further comprising a mounting member configured to support said one end of the arm from the shell thereby providing pivotal movement of the arm between a stored position adjacent the shell and away from the opening and an active position extending in the opening.

7. The cleansing facility of claim 1, further comprising a driver adapted and configured to move the arm between a stored position and an active position.

8. The cleansing facility of claim 7, further comprising a controller being adapted and configured to activate the driver to move the arm between the stored position and the active position.

9. The cleansing facility of claim 1, wherein the arm extends from a side of an inner periphery of the seat opening.

10. The cleansing facility of claim 1, wherein the air supply duct and the water supply duct are coaxially arranged.

11. A method of delivering water and air to a toilet seat for the purpose of cleansing a user, the toilet seat including a toilet seat shell defining an opening, and a cleansing arm that includes a water supply duct terminating at a water outlet at a first end of the arm, and an air supply duct terminating at an air outlet at the first end of the arm, the air supply duct having a cross-sectional area greater than a cross-sectional area of the water supply duct, the arm being configured to move longitudinally along a central axis of the seat, and the arm being configured to pivot in a plane substantially parallel to a bottom of the seat, the method comprising the steps of:

delivering water to the water supply duct and discharging the delivered water out of the water outlet; and delivering air to the air supply duct and discharging the delivered air out of the air outlet.

12. The method of claim 11, wherein the toilet seat further includes a water supply system, and the method includes delivering water to the water supply duct from the water supply system.

13. The method of claim 12, wherein the toilet seat further includes a controller, and the method further includes activating the water supply system with the controller to deliver water to the water supply duct.

14. The method of claim 11, wherein the toilet seat further includes an air delivery system, and the method includes delivering air to the air supply duct from the air delivery system.

15. The method of claim 14, wherein the toilet seat further includes a controller, and the method further includes activating the air delivery system with the controller to deliver air to the air supply duct.

16. The method of claim 11, wherein the toilet seat further includes a mounting member, and the method further includes supporting a second end of the arm from the toilet seat shell and pivoting the arm between a stared position adjacent to the toilet seat shell and away from the opening and an active position extending into the opening.

17. The method of claim 11, wherein the toilet seat further includes a driver adapted and configured to move the arm, and the method further includes moving the arm with the driver between a stored position and an active position.

18. The method of claim 17, wherein the toilet seat further includes a controller, and the method further includes activating the driver with the controller to move the arm between the stored position and the active position.

* * * * *